US006283052B1

(12) United States Patent
Pratt

(10) Patent No.: US 6,283,052 B1
(45) Date of Patent: Sep. 4, 2001

(54) TUFTING MACHINE WITH NEEDLE BAR MOTOR

(75) Inventor: Anthony R. Pratt, Warwickshire (GB)

(73) Assignee: Spencer Wright Industries, Inc., Dalton, GA (US)

( * ) Notice: Subject to any disclaimer, the term of this patent is extended or adjusted under 35 U.S.C. 154(b) by 0 days.

(21) Appl. No.: 09/566,893

(22) Filed: May 8, 2000

(51) Int. Cl.[7] ..... D05C 15/20
(52) U.S. Cl. ..... 112/80.41
(58) Field of Search ..... 112/80.4, 80.41, 112/80.43, 80.44, 80.45

(56) References Cited

U.S. PATENT DOCUMENTS 4,398,479 * 8/1983 Czelusniak, Jr. ..... 112/80.41
4,483,260 * 11/1984 Gallant ..... 112/80.41 X
4,829,917 * 5/1989 Morgante et al. ..... 112/80.41
5,205,229 * 4/1993 Job ..... 112/80.41

* cited by examiner

*Primary Examiner*—Ismael Izaguirre
(74) *Attorney, Agent, or Firm*—Alan Ruderman; Stephen J. Stark

(57) ABSTRACT

A tufting machine has a reciprocating needle bar which may be shifted laterally by a drive which includes at least one linear motor. Each linear motor has two major elements which may be coupled together electromagnetically. One of the elements is connected to a fixed portion of the tufting machine and another of the elements is connected to the needle bar. When electrical power is supplied to the motor, the element connected to the needle bar moves relatively to the other thereby moving the needle bar.

14 Claims, 4 Drawing Sheets

TUFTING MACHINE WITH NEEDLE BAR MOTOR

BACKGROUND OF THE INVENTION

1. Field of the Invention

The present invention relates to a tufting machine used for carpet manufacture.

2. Description of the Related Art

Tufting machines are distinguished over other carpet making methods in that loops of yarn which constitute the pile of the carpet are inserted in a backing medium or cloth, which may be fibrous or woven according to the carpet application. The loops are held in place by the retentive pressure of the backing cloth having been expanded locally through the insertion of the yarn. A subsequent operation covers the rear face of the yarn and backing cloth with a retaining adhesive. The adhesive also holds a further layer of backing material, usually hessian.

The yarn is inserted into the backing material by a multiplicity of needles which perform a reciprocating motion. The needles have eyes at the lower extremities through which yarn is both fed and captured. Generally, the needles are connected to one or more transverse bars known as needle bars so that all needles may be reciprocated together into and out of the backing material. In certain specialized tufting machines, the needles are carried by needle holders that may be selectively latched to a reciprocating latch bar so that the needles are capable of individual selection and only those needles selected are subject to the reciprocation, whilst those not selected are not reciprocated. The reciprocating action usually is delivered through a series of pistons or push rods couple by various conventional means to a rotating main-shaft driven by electric motor or similar means. The coupling mechanism is of a crank-shaft type so that the extent of the needle motion is the throw of the crank. Other more complex arrangements are also known which endow features to enable the motion envelope of the needle to be controlled and easily set to any desired range.

The loops of yarn may be of varying heights on the face side of the carpet in order to provide a patterning effect. There are several techniques for causing this effect, such as changing the tension of yarn from low to high from one insertion of a yarn loop to the next (high pile to low pile). Yarn tension may be set by modulating the speed of the yarn feed mechanism controlling the length of yarn delivered for each loop (stitch). A simple form of yarn feed mechanism uses a pair of rollers with a high friction surface between which the yarn is pinched. Variations in the speed of the rollers allows control of the length of yarn delivered for each tuft of carpet pile. There are many more complex mechanisms for exerting control over the yarn delivery. Some of these deliver control over individual strands of yarn, some over subsets of all the strands.

Additional patterning features include the use of cut pile as opposed to pile formed from loops. The cut pile effect is achieved usually during the tufting process by catching the loops formed by the insertion of yarn through the backing cloth on a suitably formed hook on the face (lower) side of the carpet. A knife shears the yarn on one side of the hook after several further loops have been inserted in the backing material. The knife is articulated to move in synchronism with the insertion of yarn. The hooks involved in the loop capture during yarn insertion are also arranged to move into position in synchronism with the yarn insertion process.

The foregoing is a non-exhaustive illustration of some of the features of tufting machines and the mechanisms for controlling carpet patterning. Further features of tufting machines include the ability to introduce a plurality of colors. Tufts of different colored yarns can be made to form attractive carpet patterns such as can be achieved in woven carpets in which any chosen color may be inserted in any location in the carpet by correct design of the patterning commands. One way in which this is done is by burying one colored yarn by giving it a very low pile height in an area of higher pile height of different color by the well known process of backrobbing yarn from the previous stitch to reduce the pile height of that previous stitch. When the buried color is required, the pile height is set high whilst that of the other color in that area is set lower. This results in patches of different colors but has a number of disadvantages in the wastage of yarn which cannot be seen and in the straight line arrangement of the colored yarn. Means for altering the lateral position of the yarns have consequently been developed to overcome some of these limitations.

There are normally up to two needle bars on a machine although more may be fitted. These are reciprocated by the main-shaft rotation and crank means in the vertical direction. An additional degree of freedom of motion is afforded to the needle bars by a mechanism which allows side to side motion, that is across the width of the tufting machine laterally. Yarns may thus be moved from one needle position to others. This provides greater flexibility to produce a required pattern, as needles containing a particular color can be shifted laterally to a position where that particular color is required in the pattern.

Mechanisms for moving the needle bars include cam driven systems, hydraulic actuators, pneumatic actuators, and electric servo controlled motors with a rotational to linear conversion device. This latter mechanism is typified by WO 97/15708 and EP 867,553. In these cases, the rotational to linear conversion devices include screw thread and nut arrangements (including those with acme threads and other thread profiles; ball screws; inverted roller screws and similar equivalent devices). These mechanisms provide the necessary motional requirements from a functional view but also limit the speed capability of the tufting machine. This limitation may arise due to the speed, rate of acceleration and slackness or free play in the mechanisms connecting the servo motor with the sliding needle bar; other relate to the amount of force required to provide the acceleration, inertia effects and control loop stability.

Further, with these systems, the sliding needle bar drive system, servo motors, or equivalent hydraulic or pneumatic actuators have been mounted on the external and faces of the tufting machine. This has required the provision of holes in the end plates or housing to allow the servo motor output shaft to feed into the sliding needle bar assembly. The servo motor output shaft has been coupled to a ball screw or equivalent device (such as an inverted roller screw or screw and nut assembly). The motion sensor for the servo motor has usually been coupled directly to its rotating shaft so that lost motion in any coupling mechanism between the servo and the sliding needle bar has remained uncompensated.

SUMMARY OF THE INVENTION

According to the present invention, there is provided a tufting machine comprising a housing, a needle bar which is reciprocable within the housing and on which a plurality of needles are mounted for reciprocation towards and away from a web of backing material, and at least one linear motor for moving the needle bar in a lateral direction across the width of the web, each linear motor having first and second parts which may be selectively coupled to one another by electromagnetic forces. In a preferred embodiment, the first part fixed with respect to the housing, and the second part is electromagnetically coupled with respect to the first part and fixed with respect to the needle bar, and a power source supplies electric power to one of the motor parts to drive the first and second parts relatively to one another in the lateral direction.

As a part of the linear motor is connected with respect to the needle bar, no linkage or other intervening mechanism is required to drive the needle bar laterally. The mechanism is therefore simple and cannot introduce any lost motion.

The tufting machine may have a single needle bar. However, preferably, it comprises at least one further needle bar, which is selectively driven by a linear motor for moving the further needle bar in a lateral direction across the width of the web.

The linear motor could be of the kind comprising a tubular arrangement of magnets surrounded by an annular arrangement of coils. However, in this case, a further mechanism would be required to permit reciprocation and a bearing would be required to mount the coil assembly with respect to the housing. Therefore, preferably, the or each first part fixed with respect to the housing, and the second part is electromagnetically coupled with respect to the first part and fixed with respect to the needle bar, and a power source supplies electric power to one of the motor parts to drive the first and second parts relatively to one another in the lateral direction.

As a part of the linear motor is connected with respect to the needle bar, no linkage or other intervening mechanism is required to drive the needle bar laterally. The mechanism is therefore simple and cannot introduce any lost motion.

The tufting machine may have a single needle bar. However, preferably, it comprises at least one further needle bar, which is selectively driven by a linear motor for moving the further needle bar in a lateral direction across the width of the web.

The linear motor could be of the kind comprising a tubular arrangement of magnets surrounded by an annular arrangement of coils. However, in this case, a further mechanism would be required to permit reciprocation and a bearing would be required to mount the coil assembly with respect to the housing. Therefore, preferably, the or each linear motor allows relative movement of the first and second parts in the direction of reciprocation of needle in addition to the lateral movement provided.

Preferably, one of the first and second parts is a U-shape channel extending in the lateral direction, and the other of the first and second parts is within the U-shape channel. This represents a particularly efficient way of electromagnetically coupling the first and second parts, as there is a relatively large surface area between the two parts.

Preferably the or each linear motor has a plurality of coils on the first or second part which are electrically coupled to the power source, and a plurality of corresponding magnets on the other of the first and second part, wherein the coils and magnets form the electromagnetic coupling between the two parts.

From an electromotive point of view, it does not matter whether the coils are provided on the first or the second part of the motor. However, it is preferable for the coils to be mounted on the first part of the linear motor, as this does not move during operation, thereby making for simpler electrical connections to the coil.

A particularly advantageous construction is for the coils to be provided on the first part of the linear motor which is the U-shape channel. Coils are disposed on both legs of the channel which ensures that the attractive forces between the coils and the magnets are balanced out. In this case, heat produced in the coils may now be removed by conduction through the coil mounting structure and the housing of the tufting machine, or by convection with fins provided on the outer surface of the U-shaped channel. The number of magnets is reduced where the magnets are fixed to the central web or second part of the linear motor, and is approximately half of the number required where the magnets are provided on the legs or first part of the U-shape channel. The magnet assembly is connected to the needle bar and is significantly reduced in weight as compared to a U-shape structure connected to the needle bar. This consequential reduction in the mass and inertia of the needle bar assembly allows the required motion to be completed in shorter times for the same electromotive input forces.

Preferably, there is an air gap between the first and second motor parts, so that no motor bearing is required between the two parts. There are attractive forces between the coil part of the linear motor and the permanent magnets. These are balanced in the motor construction used. Furthermore, the mechanical construction of the supporting assembly in the sliding needle bar ensures that the two parts of the motor are positioned so that they do not touch. Additional non-loaded bearings such as are made of plastic may be used between the first and second part of the motor to ensure that the air gaps are maintained with approximately the same spacing, without the need for close tolerances to be maintained elsewhere in the sliding needle bar assembly. This also means that the needles can reciprocate without requiring a mechanical coupling between motor parts to allow for this.

The tufting machine also preferably comprises a control system for controlling the motion of the or each linear motor, the control system comprising a sensor for detecting the position of at least one motor on the or each needle bar, a signal generator for generating a signal relating to the angular position of the reciprocating mechanism, and a processor provided with data relating to the pattern for the carpet to be tufted and having means to generate signals to drive the or each motor to locations determined from the sensor and signal generator readings and the data relating to the pattern.

BRIEF DESCRIPTION OF THE DRAWINGS

An example of a tufting machine constructed in accordance with the present invention will now be described with reference to the accompanying drawings in which.

DESCRIPTION OF PREFERRED EMBODIMENTS

Figure 1:
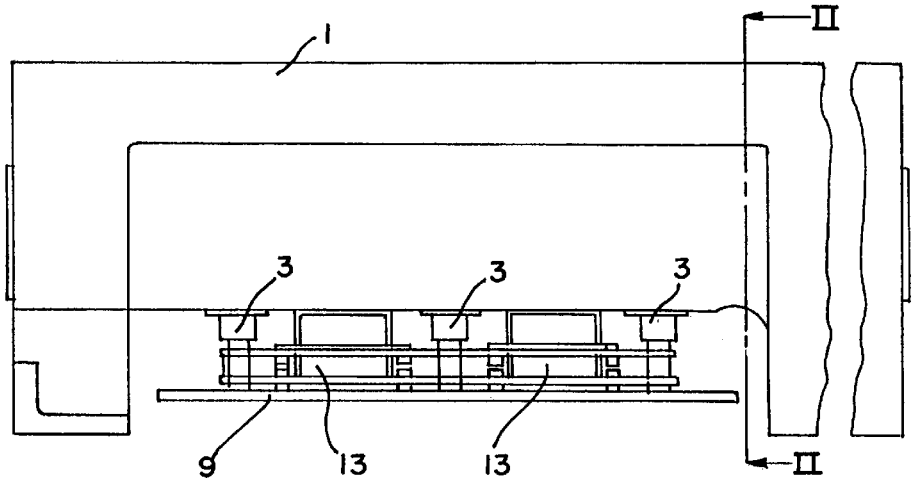
FIG. 1 is a front view showing the general arrangement of the tufting machine.
Figure 2:
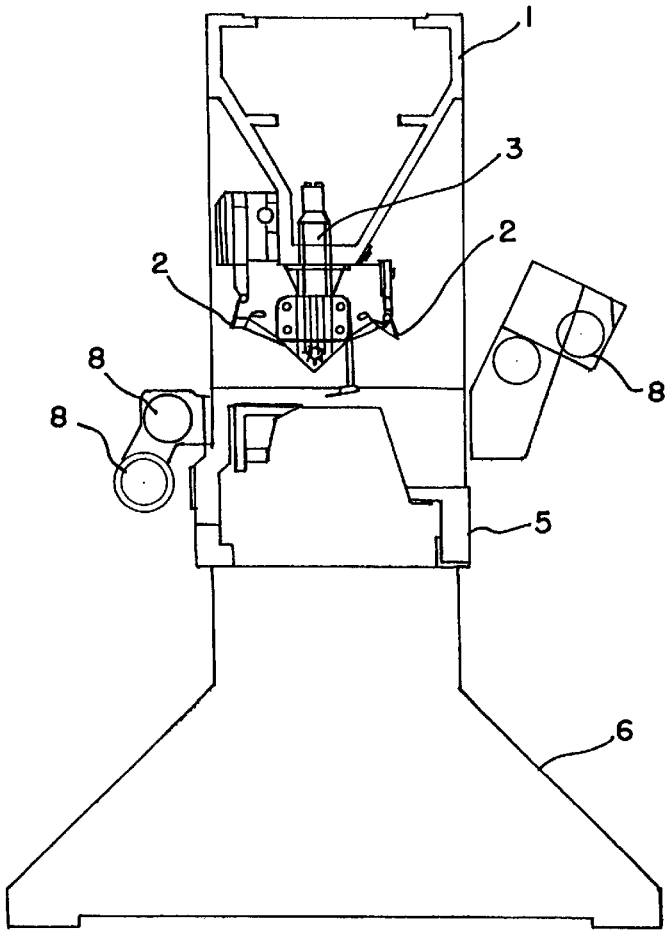
FIG. 2 is a section along line II—II in FIG. 1.

In most respects, the machine is a conventional tufting machine, so that a detailed description of the tufting operation will not be included here. The machine has a top housing 1 housing the yarn feed mechanism 2, and three reciprocating pistons 3 for reciprocating needles 4. A bottom housing 5 is mounted on legs 6 (neither of which are shown in FIG. 1) as is the bed plate 7 and is provided with a series of rollers 8 for feeding the backing medium through the machine. As the backing medium is fed through the machine, the needles 4 are vertically reciprocated by the reciprocating pistons 3 and cooperate with a plurality of hooks or loopers beneath the backing material to produce a tufted carpet in the conventional manner as is well known in the art.

Figure 3:
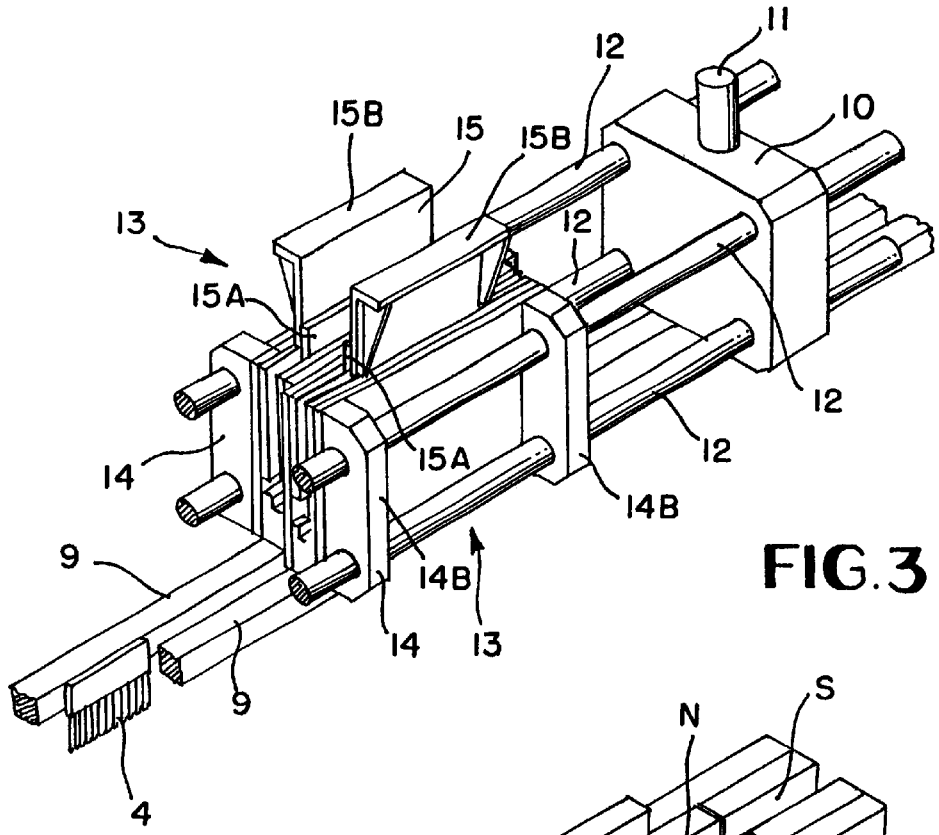
FIG. 3 is a perspective view showing two needle bars and their respective linear motors.
Figure 5:
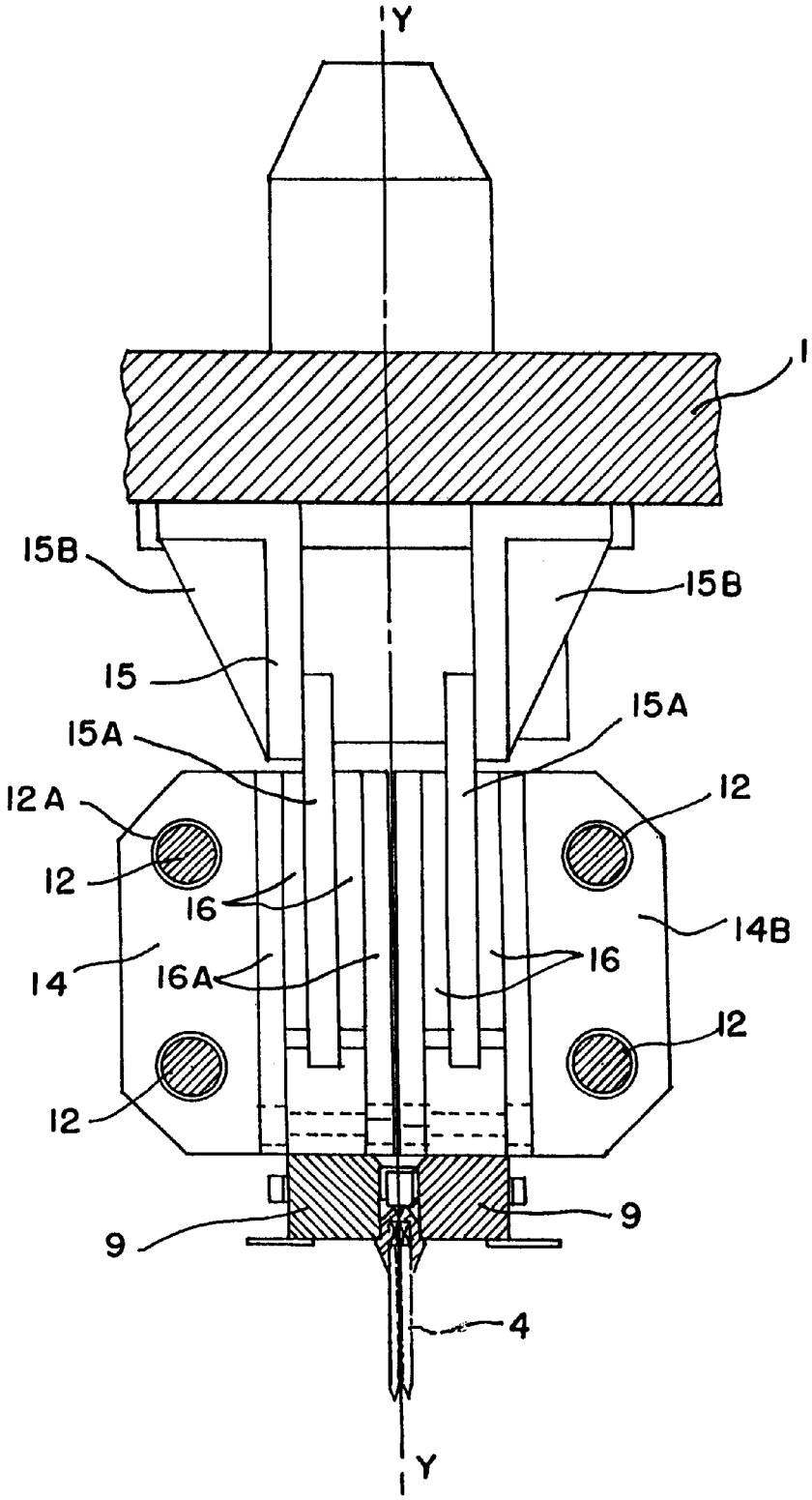
FIG. 5 is a cross-section through the two linear motors as illustrated in FIG. 3.

The apparatus shown in FIGS. 3 and 5 comprises a pair of needle bars 9, each of which have needles 4 connected along their length. Three plates 10 are reciprocally vertically movable by means of a respective push rod 11 driven by a respective reciprocating motion piston 3. As shown in FIG. 3, the plates 10 are connected by four laterally extending guide bars 12 which are rigidly fixed to the plates 10. Each needle bar 9 is associated with its own pair of laterally spaced linear motors 13 as shown in FIG. 1. The detail of one such linear motor for each needle bar 9 is shown in FIGS. 3 and 5. In FIG. 5, the linear motor for one needle bar 9 is on one side of the center line Y—Y, while the other linear motor is on the other. Each linear motor comprises a sliding part 14 and a static part 15. Each sliding part 14 comprises a magnet support 14A mounted to a respective needle bar 9 and a mounting part comprising a pair of flanges 14B which are slidable along two of the guide bars 12 on linear bearings 12A so as to move the needle bar 9 laterally.

Figure 4:
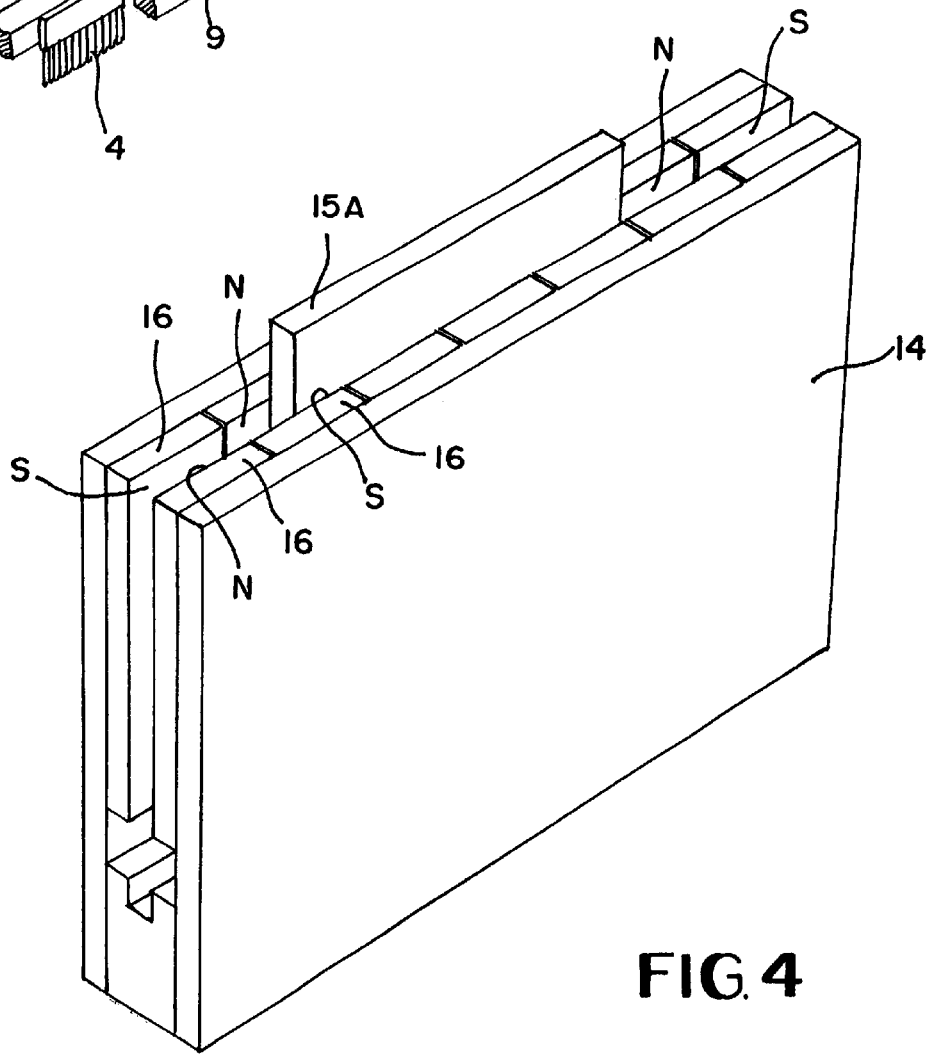
FIG. 4 is a perspective view showing the detail of one linear motor.

The construction of the linear motor is shown in greater detail in FIG. 4. The sliding part 14 has a generally U-shape channel extending laterally. The sliding part 14 is made from aluminum, and has a series of magnets 16 fitted to the inside of the U-shape channel in such a way as to provide an alternating magnetic field along the length of the channel. The magnets are arranged as shown in FIG. 4 with their poles alternating both along the channel, and across the channel. The poles shown in FIG. 4 are those which face towards the center of the channel. The outer sides of the magnets have the opposite magnetic sense to those parts facing the inner side of the U-shape channel as shown. In normal construction, there is an air gap or other non-magnetic part positioned between each magnet in order to provide separation between said magnets.

The fixed part 15 is provided with a plurality of coils 15A fixed to the housing by a bracket 15B. These coils 15A are elongate in the vertical direction and are not of approximately the same pitch as the magnets or the motor would lock in position and not move. Special arrangements are made in respect of the coil arrangement to prevent the cogging effect of identical pitch as shown in U.S. Pat. No. 5,642,013.

Referring to FIG. 3, it should be noted that all of the parts illustrated in this figure, with the exception of the fixed parts 15 will reciprocate vertically with the needles 4. Reciprocating vertical motion is thus provided to the needles 4 from the reciprocating pistons 3, via push rods 11, plates 10, guide bars 12, sliding parts 14 and needle bars 9. The effect of this will be to cause the moving part 14 to reciprocate vertically with respect to the fixed part 15. An air gap (not shown in FIG. 5) between the two parts ensures that this motion can be accommodated without requiring any bearings between the two.

The application of electrical power to the coils 15A will cause a corresponding lateral movement of the sliding part 14 along guide bars 12, causing the attached needle bar 9 and needles 4 to be moved laterally.

As the sliding part 14 is moved downwardly during reciprocation, the electromotive force will be diminished, as the coils 15A on the fixed part 15 will be partially or completely moved out of the magnetic way provided in the U-shape channel. Lateral movement of the needles bar will normally be made when the needles are out of the backing and at approximately 25 to 30° of top dead center (TDC) and thus the U-channel and coil assembly are nearly fully engaged. In this condition the motor exerts nearly or exactly its maximum force capability and provides the greatest lateral acceleration.

The linear motor is servo-driven and hence requires the means to commutate the coils to provide a reaction force. For this purpose, there is a Hall-effect (magnetic) sensor (not shown) or equivalent embedded in the coil assembly which provides feedback of the location of the coil assembly in relation to the magnetic field formed in the U-shape channel.

A further requirement of the servo controlled motor is that there be means to measure the location of the motor relatively to the rest of the machine. This takes the form of positional sensors, which may be optical or magnetic, external to the motor assembly. The measuring system must be insensitive to the vertical reciprocating motion of the needles, while providing precise transverse location data. In order to achieve this, the Hall-effect sensor used for commutation may also be used to provide location data. As an alternative to a separate location measurement sensor, the Hall-effect sensor or equivalent used for commutation may also be used to provide location data for the position feedback function.

When in the raised position, with the coil assembly fully inserted into the U-shape channel, the needle bar is subject to rapid movement using the linear motor. This changes the position of the needle bar, if required by the pattern commands, usually by an integer number of gauge jumps (that is an integer number times the distance between each needle). Some patterns require needle bar shifts by other non-integer distances as disclosed in U.S. Pat. No. 4,501,212 as will be recognized by those skilled in the art of tufted carpet design. In such cases, it is normal for the motion of the sliding needle bar to occur whilst the needles are still engaged in the backing cloth. In this case only a fraction of the full force available from the motor is necessary and is available in this configuration. For motions of the needle bar requiring an integer number of gauge jumps, the needles are in a withdrawn state from the backing web and the motor parts are more or less fully engaged. The motive force available in this raised condition is at a maximum. The motive force available from the motor is at a maximum in this raised condition. The motion of the linear motor is controlled by a servo amplifier and position control system offering the features of velocity and acceleration feed-forward. These last two characteristics ensure that the motion of the needle bar 9 has little position over shoot. This optimum combination of these control settings minimizes the overall duration of the needle bar motion. The tightly coupled nature of the structure ensures that the position measurement of the servo control system accurately reflects that of the sliding needle bar with no lost motion or slack as in previous machines.

Figure 6:
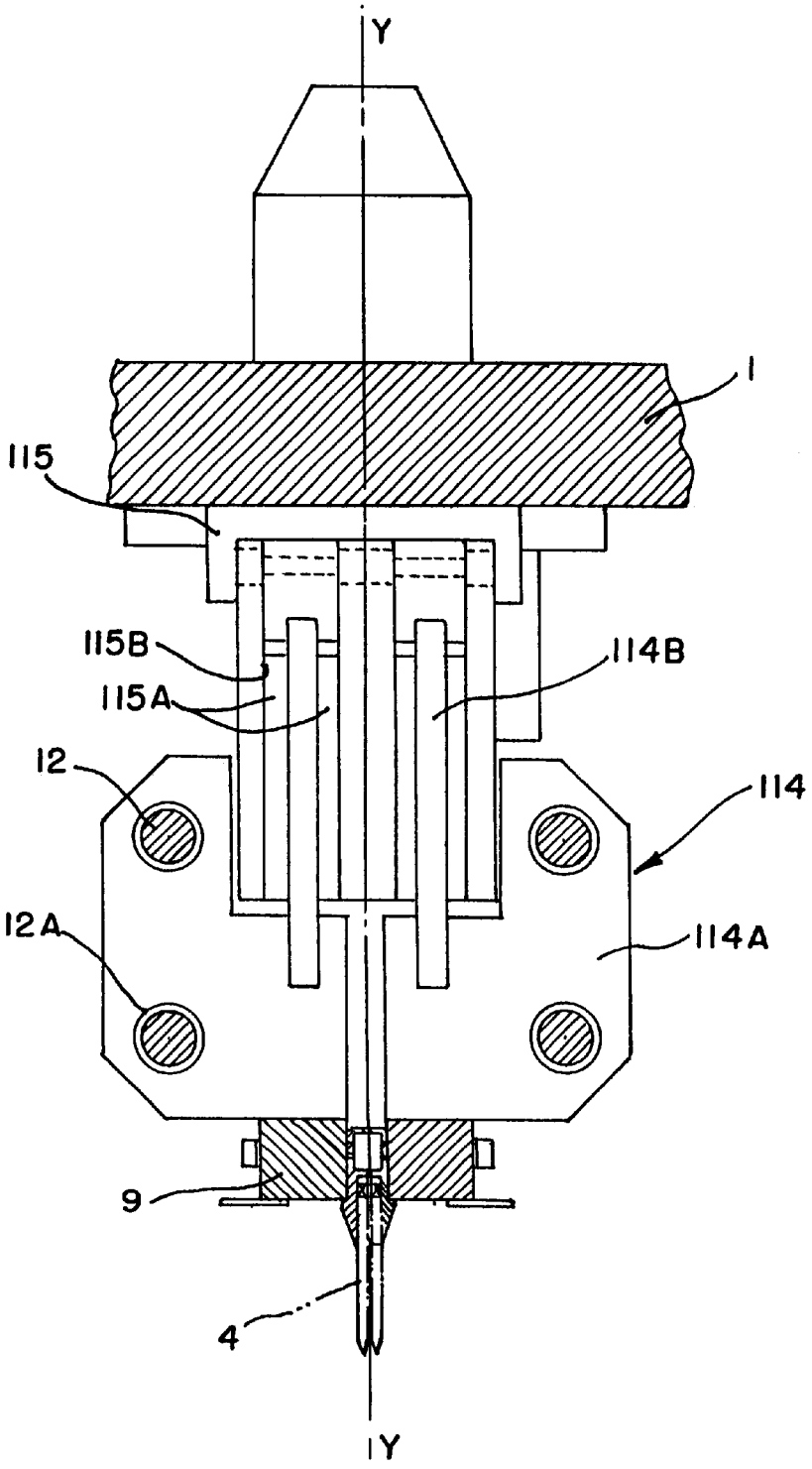
FIG. 6 is a cross-section similar to FIG. 5 showing an alternative arrangement of linear motor.

An alternative arrangement of linear motor is shown in FIG. 6. In many respects, this example is similar that shown in the other figures and the same reference numerals have been used, where appropriate, to designate the same components.

The difference between this example and that previously described is essentially that the part with the coils which is fixed to the housing 1 is now the U-shape channel while the magnets are within this U-shape channel.

More particularly, the fixed part 115 of the linear motor has a plurality of coils 115A fixed to the inside of a downwardly opening U-shape channel 115B which is fixed at its top end to housing 1. The sliding part 114 comprising a mounting part 114A arranged to slide on two of the guide bars 12 and to which a needle bar 9 is mounted. A set of magnets 114B project upwardly from the mounting part 114A into the U-shape channel 115B between the coil assemblies 115A. An air gap (not shown in FIG. 6) is provided between the magnets and coils. The set of magnets 114B has the same alternating configuration as that shown in FIG. 4, and cooperates with the coils 115A which are correspondingly arranged in order to drive the needle bar 9 laterally.

Other forms of linear motors may be used in the tufting machine without departing from the invention. For example, besides the U-shaped channel arrangement, there is a known open form of linear motor in which the magnets form one part and the energized coils form the other part. Also, there is known an enclosed form of motor in which the magnets are arranged inside a thin walled tube an inner part) and the energizing coils are arranged in another tubular form (the outer part) with the magnet assembly sliding in the circumferentially arranged outer coils.

The 'open' form of linear motor experiences considerable attractive force between the permanent magnets and the coil structure in operation. Bearings are required to resist these otherwise unusable forces.

In all of these arrangements, the motors use permanent magnets and coils to generate the electromotive forces, although it would be possible to have the permanent magnet system replaced by electrical excitation (as in a DC excited dynamo). Unfortunately, the steady state fields produced by coils subject to electrical excitation are significantly smaller than those available from rare earth magnets (due to coil heating effects. Improvements in cooling the coils may be contemplated using alternative thermal conductivity mechanisms such as heat pipes. The heating effects may be avoided using superconductivity effects). Consequently, such motors are relatively inefficient and thus not currently practical.

Some forms of linear motor may preferably be mounted on the body of the tufting machine away from the tufting area and coupled to the sliding needle bars using a translated motion mechanism by which the linear motions from the motor are transmitted to the sliding needle bar and the sliding needle bar can be substantially reciprocated without affecting the translated linear motion. This arrangement is similar to rotational 'servo-controlled' motors and rotation-to-linear conversion mechanism (ball screw, lead screw, etc.).

Some simple translated motion devices exhibit coupling between the desired horizontal motion required in the sliding needle bar of the tufting machine and the reciprocation of the needle assembly. This coupling can be removed by either open or closed loop techniques with the linear motor arrangement. An example of simple coupling mechanism is a bar coupled at one end to the linear motor moving part and at the other end to the sliding needle bar assembly. Rotational bearing are necessary to allow the bar to move in the direction of reciprocation. In the open loop compensation method, the linear motor is excited with a correction motion profile linked to the motion of the needle bar assembly so as to compensate for the variations in the resolved length of the bar in the horizontal plane (perpendicular to the direction of reciprocation). In the closed loop compensation arrangement, the sliding needle bar location sensor (mounted on the needle bar in the first part and on the machine housing in the second part) provides error signals to the motion control system which operates to reduce the errors to a small quantity. Such a closed loop control system may be aided by the additional input of approximate corrections such as would be used in the open loop compensation arrangement.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed therein is:

1. A tufting machine comprising a housing, a needle bar mounted for reciprocation vertically in the housing, said needle bar carrying a plurality of needles driven vertically towards and away from a web of backing material fed through the machine beneath the needle bar, and at least one electric linear motor for moving the needle bar in a lateral direction across the width of the web, said at least one linear electric motor comprising a first part connected to the housing, a second part electromagnetically coupled with respect to the first part and connected to the needle bar, and a power source for supplying electric power to provide an electromagnetic force to drive the first and second parts relatively to one another in the lateral direction.

2. A tufting machine as recited in claim 1, wherein said first part is fixed to said housing and said second part is fixed to said needle bar.

3. A tufting machine according to claim 2 comprising at least one further needle bar, said at least one further needle bar being provided with at least one additional linear motor or moving the further needle bar in a lateral direction across the width of the web, said at least one additional linear motor comprising a first part fixed with respect to the housing and a second part electromagnetically coupled with respect to the first part and fixed with respect to said at least one further needle bar, and a power source for supplying electric power to provide an electromagnetic force to drive the first and second parts relatively to one another in the lateral direction.

4. A tufting machine according to claim 1 wherein said at least one linear motor allows relative movement between the first and second parts in the direction of reciprocation of the needles.

5. A tufting machine according to claim 4, wherein one of the first and second parts is a U-shape channel extending in the lateral direction, and the other of the first and second parts is within the U-shape channel.

6. A tufting machine according to claim 1, wherein said at least one linear motor has a plurality of coils on the first or second part which are electrically coupled to the power source, and a plurality of corresponding magnets on the other of the first and second part, wherein the coils and magnets form the electromagnetic coupling between the two parts.

7. A tufting machine according to claim 5, wherein the coils are mounted on the first part and magnets are mounted on the second part.

8. A tufting machine according to claim 1, wherein there is an air gap between the first and second parts.

9. A tufting machine according to claim 2, wherein said at least one linear motor allows relative movement between the first and Second parts in the direction of reciprocation of the needles.

10. A tufting machine according to claim 9, wherein one of the first and second parts is a U-shape channel extending in the lateral direction, and the other of the first and second parts is within the U-shape channel.

11. A tufting machine according to claim 2, wherein said at least one linear motor has a plurality of coils on the first or second part which are electrically coupled to the power source, and a plurality of corresponding magnets on the other of the first and second part, wherein the coils and magnets form the electromagnetic coupling between the two parts.

12. A tufting machine according to claim 10, wherein the coils are mounted on the first part and magnets are mounted on the second part.

13. A tufting machine as recited in claim 2, wherein there is an air gap between the first and second parts.

14. A tufting machine as recited in claim 3 wherein there is an air gap between the first and second parts.

* * * * *